United States Patent [19]

Iwata et al.

[11] 4,411,539

[45] Oct. 25, 1983

[54] PRINT ELEMENT WITH PLURAL TYPE LAYERS OF VARYING THICKNESS

[75] Inventors: Nobuo Iwata, Sagamihara; Takashi Hasegawa, Hiratsuka, both of Japan

[73] Assignee: Ricoh Company, Ltd., Japan

[21] Appl. No.: 331,677

[22] Filed: Dec. 17, 1981

[30] Foreign Application Priority Data

Dec. 18, 1980 [JP] Japan ..... 55-179482

[51] Int. Cl.[3] ..... B41J 1/26

[52] U.S. Cl. ..... 400/144.2; 400/174; 101/93.17; 101/93.03

[58] Field of Search ..... 101/93.03; 400/452, 400/174, 175, 144, 144.1, 144.2, 162

[56] References Cited

U.S. PATENT DOCUMENTS

| | | | |
|---|---|---|---|
| 3,848,722 | 11/1974 | Bolan et al. | 400/175 |
| 4,291,993 | 2/1981 | Gagnebin | 400/175 |
| 4,335,970 | 6/1982 | Iwata et al. | 400/174 |

FOREIGN PATENT DOCUMENTS

| | | | |
|---|---|---|---|
| 17918 | 10/1980 | European Pat. Off. | 93.03/ |
| 197806 | 6/1978 | Fed. Rep. of Germany | 101/93.03 |
| 2831009 | 11/1979 | Fed. Rep. of Germany | 400/174 |
| 2021485 | 12/1979 | United Kingdom | 101/93.03 |

OTHER PUBLICATIONS

"Print Impression Control Device" IBM Technical Disclosure Bulletin, vol. 19, No. 2, Jul. 1976 pp. 443–444.

"Print Hammer Compensation" IBM Technical Disclosure Bulletin, vol. 19, No. 10, Mar. 1977 p. 3693.

"Print Wheel" IBM Technical Disclosure Bulletin, vol. 19, No. 8, Jan. 1977, p. 2990.

*Primary Examiner*—E. H. Eickholt

*Attorney, Agent, or Firm*—Guy W. Shoup; Eliot S. Gerber

[57] ABSTRACT

A print element for a printer having a multiplicity of type members arranged in a plurality of layers are supported on a support member or support members and one of said type members is brought to a predetermined printing position in which the type member strikes a sheet of paper wound on a paper to carry out printing by the type member. The thicknesses of the type members are varied from one another depending on the position in which each type member is arranged and on the vertical dimension of each type member. And when the type members are disposed in two layers on the forward ends of spokes extending from a center hub of the print element, and the back of the support member is struck by a print hammer to carry out printing by the type member, the support member has its thickness varied in accordance with the thickness of the type member supported thereon, so that the sum of the thickness of each type member and the thickness of the support member is substantially constant for all the type members.

3 Claims, 24 Drawing Figures

PRINT ELEMENT WITH PLURAL TYPE LAYERS OF VARYING THICKNESS

BACKGROUND OF THE INVENTION

This invention relates to a print element for use with a printer having a multiplicity of type members arranged in a plurality of layers.

Generally, in a printer such as a serial impact printer, a print element is used. The print element may be of different types. FIG. 1 shows a print element in the form of a disc type print wheel generally referred to as a daisy wheel including a plurality of spokes 2 extending radially from a center hub and supporting at their forward end portions type members 5 and 6 located on support members 3 and 4 respectively and arranged in a plurality of circumferences. FIG. 2 shows a bowl type print wheel including a plurality of spokes 2 arranged around a cylindrical or frustoconical surface and supporting at their forward end portions a multiplicity of type members 5 and 6 supported on the support members 3 and 4 respectively. Said daisy wheel and bowl type print wheel are generally referred to as petal type print wheels. In many of these type wheels, type members are arranged in two layers on one spoke in order to contain many characters necessary for printing. FIGS. 1 and 2 show examples of this arrangement of the type members. When the type members are disposed in a plurality of layers, the print wheel is mounted through a universal joint on the drive shaft of a selection motor in the case of the disc type print wheel shown in FIG. 1. In the case of the bowl type print wheel shown in FIG. 2, the wheel is mounted slidably on the drive shaft and the print wheel is shifted in the vertical direction by a print signal, to bring one of the type members 5 and 6 to a predetermined print position as shown in FIG. 3 and give an impact to the back of the support members 3 or 4 by a print hammer 10. Thus the type member 5 or 6 strikes through an inked ribbon 9 a sheet of paper 8 wound on a platen 7 to carry out printing.

In this case, the adjacent type members are preferably located as close as possible to each other to reduce the radius of the print wheel, in order to make it possible for the print wheel to rotate at high speed by reducing the moment of inertia of the print wheel as a whole. In the print wheel of the type in which the type members are arranged in two layers in each of the spokes, it is necessary that the spacing interval between the print members of the two layers be minimized so as to reduce the time required for the shifting of the print wheel in a vertical direction and simplify the shifting mechanism by reducing the distance covered by the vertical shifting movement of the type wheel.

The type members 4 and 5 have their surfaces concavely curved as shown in FIG. 4 to conform to the shape of the outer peripheral surface of a platen 7. Generally, the height a of the central portion of each of the type members 5 and 6 from the surface of one of the support members 3 and 4 has had the same value for all the type members 5 and 6. Thus in the case of a print wheel having the two type members 5 and 6 on each of the spokes 2, the central portions of the two type members 5 and 6 naturally have the same value a. When this is the case, there would be the possibilities that as printing is carried out on the paper 8 by the type member 6 as shown in FIG. 5, the spoke 2 would be flexed toward the platen 7 in the forward end portion thereof as seen from the type member 6 by inertia at the time an impact is given to the type member 6 and a lower end portion 5*a* of the type member 5 would also strike the paper 8 if the distance between the two type members 5 and 6 were reduced. This would result in the spoiling of the paper 8 by ghost printing.

The position in which a type member is struck by the print hammer 10 is constant at all times because a hammer guide 11 (see FIG. 3) is fixed, and impact is given by the print hammer 10 to the center of the back of each of the support member 3 and 4. The type members 5 and 6 on the surfaces of the support members 3 and 4 respectively differ from each other in position or size with respect to the center at which the impact is given to the back of each support member, depending on whether the type members are characters or symbols. Assume that, as shown in FIG. 6, a characters, such as ¼, which is more elongated downwardly than ordinary capital letters, such as A, B and C, is supported on the support member 3 as the type member 5, and the character 6 supported on the support member 4 is a type member, such as ",", which is disposed in a position below the center of the support member 4 at which impact is given. In the case of a spoke which supports type members of this type of combination, no problems are raised when printing is carried out by the type member 5 as shown in FIG. 7 because the distance $l_1$ between an impact center $\phi_1$ and an upper end 6*b* of the type member 6 and hence the gap $\delta_1$ between the upper end 6*b* of the type member 6 and the platen 7 is large. However, when printing is carried out by the type member 6 as shown in FIG. 8, the distance $l_2$ between an impact center $\phi_2$ and a lower end 5*a* of the type member 5 is small and hence the gap $\delta_2$ between the lower end 5*a* of the type member 5 and the platen 7 is small. Thus even if the support members 3 and 4 of the two type members 5 and 6 are formed integrally with each other, ghost printing tends to be performed by the lower end portion 5*b* of the type member 5.

The characters and symbols that extend downwardly more than the ordinary capital letters include, besides the aforesaid "¼", "2/4", "½", "¾", "/", "(","(", "{","}", "δ", "ϱ", "#", etc. The symbols whose type faces deviate upwardly or downwardly from the impact center include, besides the aforesaid ",", ".", "'", "-", "∧", "'", "~", "°", etc.

SUMMARY OF THE INVENTION

Accordingly this invention has as its object the provision of a print element of simple construction capable of eliminating the trouble of producing ghost printing when the type members are arranged in two layers in the print wheel.

The aforesaid object is accomplished according to the invention by varying the thicknesses of the type members in accordance with the position in which the type members are located, deviation of the type members from the center in which an impact is given by the print hammer, or the vertical dimensions of the type members. By altering the thicknesses of the backs of the support members for the type members so as to render substantially uniform the total of the thickness of each type member and the thickness of the support member for all the type members, it is possible to obtain a uniform printing pressure and a uniform print density. Uniform printing pressure can be obtained by controlling the force of impact for accelerating the print hammer in accordance with the thicknesses of the type members.

DETAILED DESCRIPTION OF THE PREFERRED EMBODIMENTS

Figure 9:
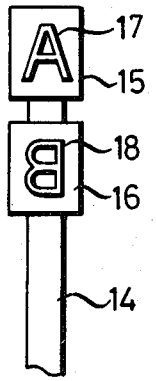
FIG. 9 is a front view of the type section on a spoke of the print wheel comprising one embodiment of the invention.
Figure 10:
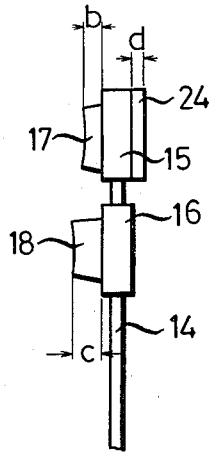
FIG. 10 is a side view of the type section shown in FIG. 9.
Figure 11:
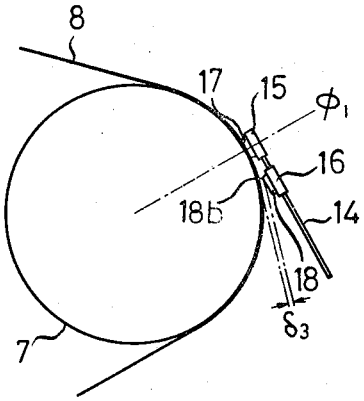
FIGS. 11 and 12 are side views showing the manner in which printing is carried out by using the type section shown in FIG. 9.

Preferred embodiments of the invention will now be described by referring to the drawings. FIGS. 9 and 10 show a type section on a spoke of a petal type print wheel comprising one embodiment of the invention. A spoke 14 has formed at its forward end portion an outer support member 15 and an inner support member 16 supporting thereon a type member 17 representing a character "A" and a type member 18 representing a character "B" respectively. As shown in FIG. 10, the type member 17 has a thickness b and the type member 18 has a thickness c which is greater than b. The difference between b and c is set at a value such that when printing is carried out by the type member 17 as shown in FIG. 11, an upper end portion **18*b* and a platen 11 define therebetween a gap $\delta_3$ of a suitable size. The back of the support member 15 is displaced rearwardly as compared with the back of the support member 16** a distanced substantially equal to the difference between b and c.

Thus when printing is carried out by the type member 17 as shown in FIG. 11, the upper end portion **18*b* of the type member 18 becomes close to the platen 7 but a portion of the spoke 14 on the type member 18 side is not flexed when an impact is given to the type member 17 so that the spoke 14 is prevented from flexing toward the platen 7. Thus the gap $\delta_3$ of a suitable size is defined between the upper end portion 18*b* of the type member 18 and the platen 7** and no ghost printing takes place.

Figure 12:
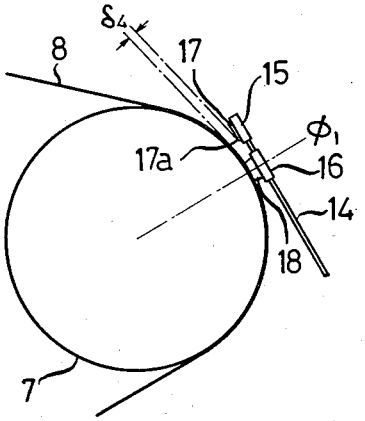

Meanwhile when printing is carried out by the type member 18, the type member 17 located on the free end side of the spoke 14 tends to flex toward the platen 7 due to inertia at the time an impact is given to the type member 18. However, since the type members 17 and 18 have thickness b and c respectively which are in the relation $b<c$, so that a lower end portion **17*a* of the type member 17 which is closest to the type member 18 to be used for printing and the platen 7 define therebetween a gap $\delta_4$ which is sufficiently large to prevent ghost printing to be caused to occur by the lower end portion 17*a* of the type member as shown in FIG. 12**.

Figure 13:
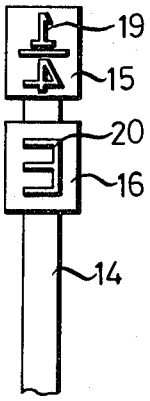
FIG. 13 is a front view of the type section on a spoke of the print wheel comprising another embodiment of the invention.
Figure 14:
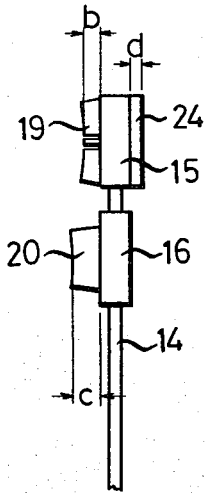
FIG. 14 is a side view of the type section shown in FIG. 13.
Figure 15:
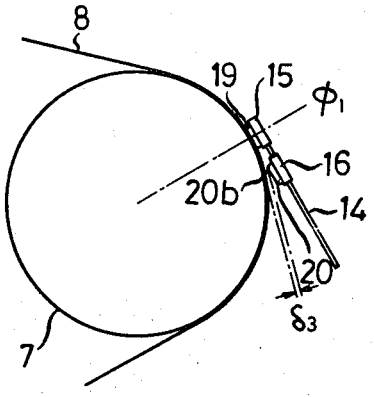
FIGS. 15 and 16 are side views showing the manner in which printing is carried out by using the type section shown in FIG. 14.
Figure 16:
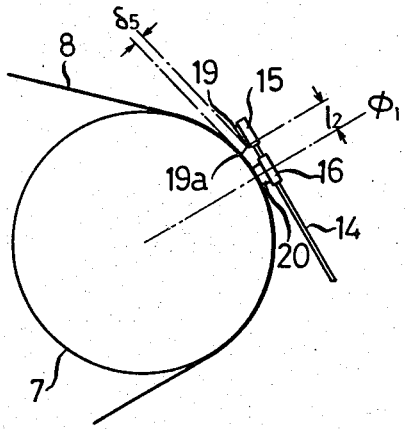

Assume that as shown in FIG. 13 the support member 15 located on the outer side supports thereon a type member 19 representing a character "¼" which has a larger length than ordinary capital letters and the support member 16 located on the inner side supports thereon a type member 20 representing a character "E" of ordinary length. In this case, the distance $l_2$ between the impact center $\phi_1$ of the type member 20 and a lower end portion **19*a* of the type member 19 is smaller as shown in FIG. 16 than would be the case if the type members represented characters, such as "A" and "B", which have an ordinary length. Thus when printing is carried out by the type member 20, ghost printing would tend to take place as the lower end portion 19*a* of the type member 19 strikes the platen 7, if the type member 19 and 20 were of the same thickness. By increasing the thickness c of the type member 20 a suitable amount as compared with the thickness b of the type member 19 as shown in FIG. 16, a gap $\delta_5$ of a suitable size can be defined between the lower end portion 19*a* of the type member 19 and the platen 7, thereby avoiding the occurrence of ghost printing by the lower end portion of the type member 19. There will be no need to describe that the thicknesses b and c of the type members 19 and 20 are selected such that when printing is carried out by the type member 19 as shown in FIG. 15, the gap $\delta_3$ of a suitable size is defined between an upper end portion 20*b* of the type member 20 and the platen 7**.

Figure 17:
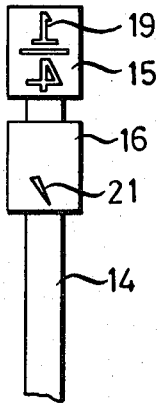
FIG. 17 is a front view of the type section on a spoke of the print wheel comprising still another embodiment of the invention.
Figure 18:
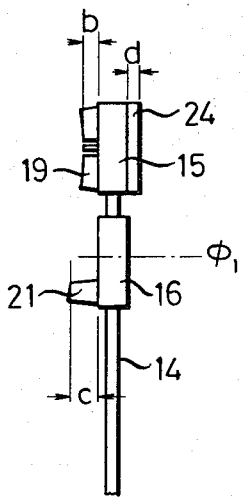
FIG. 18 is a side view of the type section shown in FIG. 17.
Figure 19:
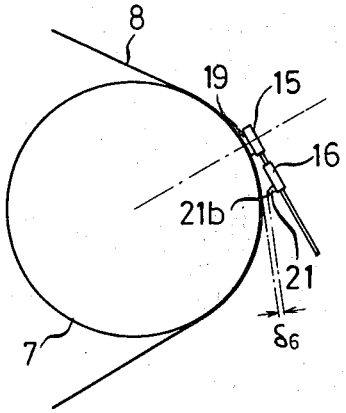
FIG. 19 is a side view showing the manner in which printing is carried out by using the type section shown in FIG. 18.
Figure 20:
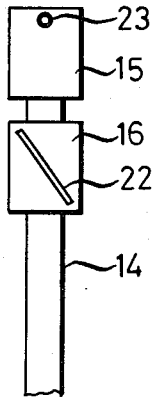
FIG. 20 is a front view of the type section on a spoke of the print wheel comprising a further embodiment of the invention.
Figure 21:
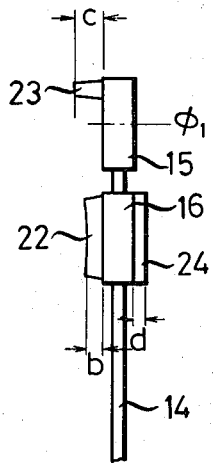
FIG. 21 is a side view of the type section shown in FIG. 20.

When the outside support member 15 supports a type member 19 representing a character of a large size, such as "¼", the inner support member 16 advantageously supports, as shown in FIGS. 17 and 18, a type member 21 representing a character such as "," which is disposed below the impact center $\phi_1$. This enables a gap $\delta_6$ defined between an upper end portion **21*b* of the type member 21 and the platen 7 to be increased as shown in FIG. 19 when printing is carried out by the type member 19. Conversely, when the inside support member 16** supports a type member 22 representing a character of a large length, such as "/", as shown in FIGS. 20 and 21, the outside support member 15 advantageously supports a type member 23 representing a character, such as " " which is located higher than the impact center $\phi_1$. In this case, one has only has to reduce the thickness b of the type member 22 below the thickness c of the type member 23 as shown in FIG. 21.

In the embodiment shown and described hereinabove, a gap of a suitable size can be provided between either of the upper and lower type members and the platen 7 without regard to the type member used for carrying out printing by varying the thicknesses of the two type members 15 and 16 supported on one spoke, depending on the position in which the type members are located, the degree of deviation of the type members from the center of an impact given by the print hammer or the vertical height of the type members, or whether the type members are generally of a large size, such as "A" and "B" or the type members have a large vertical dimension, such as "¼", "/", "[", "]", etc. This is conducive to prevention of the occurrence of ghost printing.

Figure 1:
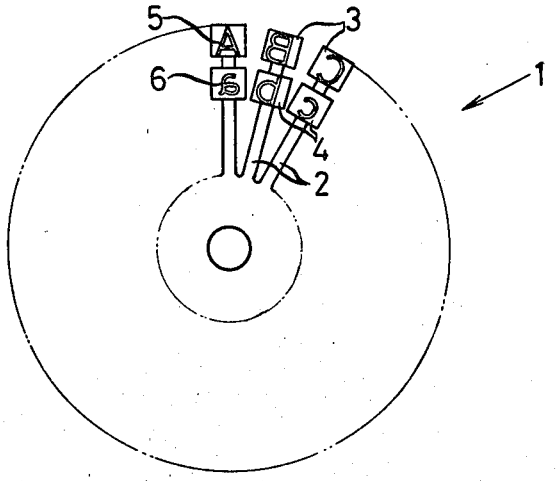
FIG. 1 PRIOR ART
FIGS. 1 and 2 are views showing a petal type print wheel of the prior art.
Figure 2:
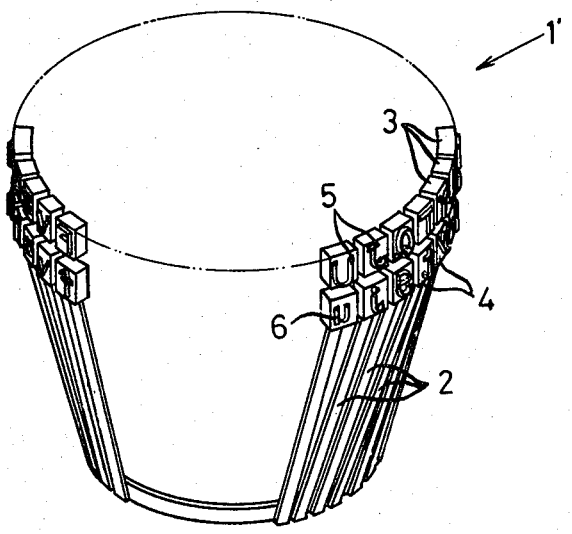
FIG. 2 PRIOR ART
Figure 3:
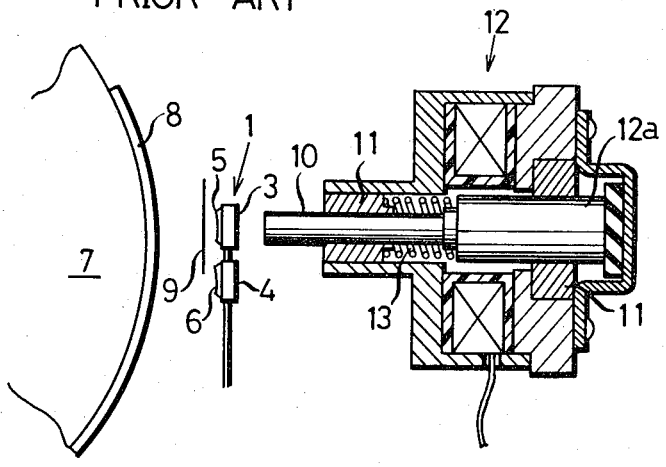
FIG. 3 PRIOR ART
FIG. 3 is a sectional view showing one example of a print hammer device of the prior art.
Figure 4:
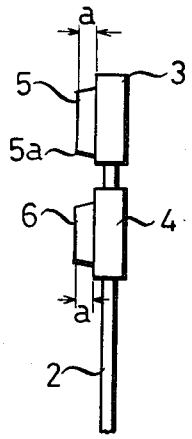
FIG. 4 PRIOR ART
FIG. 4 is a side view of the forward end portion of a spoke of a petal type print wheel of the prior art in which two type members are located in two layers.
Figure 5:
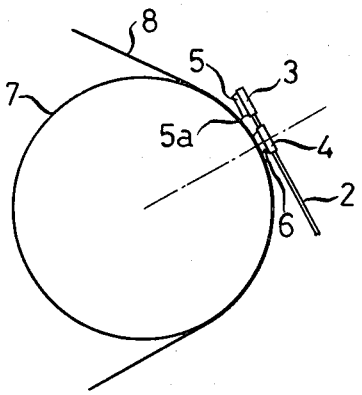
FIG. 5 PRIOR ART
FIG. 5 is a side view showing the manner in which printing is carried out by the print wheel shown in FIG. 4.
Figure 6:
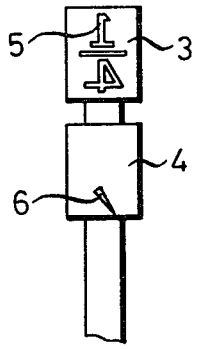
FIG. 6 PRIOR ART
FIG. 6 is a front view of type members of a petal type print wheel, showing one example thereof.
Figure 7:
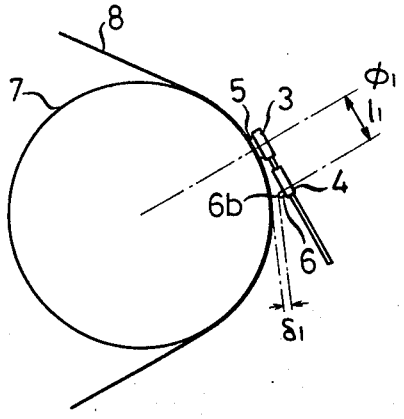
FIG. 7 PRIOR ART
FIGS. 7 and 8 are side views showing the manner in which printing is carried out by the print wheel shown in FIG. 6.
Figure 8:
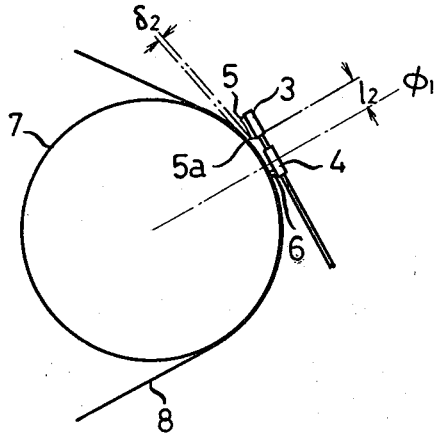
FIG. 8 PRIOR ART

FIG. 3 shows a known construction of a print hammer device of a printer. A hammer 10 is connected to the forward end of a plunger 12*a* of a solenoid 12 as a unit and normally located in an inoperative position away from the platen 7 by the biasing force of a compression coil spring 13. Upon the solenoid 12 being energized for a short period of time by a printing signal, the plunger 12*a* having the hammer 10 at its forward end is actuated and moves toward the platen 7 against the biasing force of the coil spring 13. Even after the solenoid 12 is de-energized, the hammer 10 and plunger 12*a* move forwardly by inertia. However, their speed of forward movement is gradually reduced by the biasing force of the coil spring 13 until the hammer 10 strikes either one of the backs of the support members 3 and 4 with a suitable force, so that printing is carried out on the paper 8 through the inked ribbon 9 as one of the type members 5 and 6 is brought into contact with the platen 7 through the paper 8 and the inked ribbon 9.

Thus if the support members have a constant thickness when the outside type member and the inside type member have different thicknesses according to the invention, the hammer would have to travel a greater distance when it strikes the back of the type member of a smaller thickness than when it strikes the back of the type member of a smaller thickness than when it strikes the back of the type member of an ordinary thickness before the type member is brought into contact with the paper on the platen. The result of this would be that due to a reduction in the impact with which the hammer strikes the back of the support member, a variation might be caused to occur in the density of the printed characters depending on the thicknesses of the type members.

According to the invention, when the type members have a thickness b which is smaller than the ordinary thickness c, the thickness of the support member 15 or 16 is increased by an amount substantially equal to the difference in the thickness of the type members or c–b in all the embodiments of the invention. Thus in a print wheel according to the invention the sum of the thickness of each type member and the thickness of its support member is constant for all the type members supported on the print wheel. By this arrangement, the stroke of the hammer can be made constant from its inoperative position to the position in which all the type members strike the surface of the paper on the platen, and consequently the force of impact with which the hammer strikes the back of each support member can be made equal. This is conducive to elimination of differences in the density of the printed characters even if the thicknesses of the type members are varied.

Figure 22:
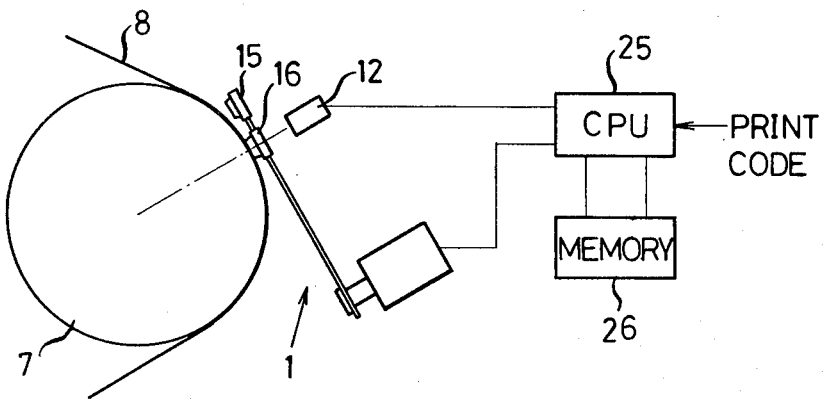
FIG. 22 is a diagram showing one example of the printing pressure control system.

It is also possible to eliminate the occurrences of different density in the printed characters by effecting control electrically without varying the thicknesses of the support members. More specifically, since the address of the type members is fixed for the print element or print wheel, it is possible, by providing a control section 25 and a memory 26 as shown in FIG. 22, for the control section 25 to receive the type member address and printing information therefor from the memory 26 upon inputting of an encoded print instruction. It is, therefore, possible to control the printing pressure applied by the hammer 10 by controlling the period of time during which a current is passed to the solenoid (12 shown in FIG. 3), in addition to control the direction and amount of rotation of the selection motor.

Figure 23:
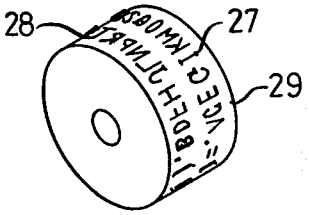
FIG. 23 is a perspective view of one example of the cylinder type print head.
Figure 24:
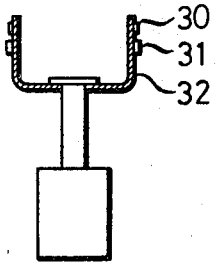
FIG. 24 is a sectional view of one example of the glass type print head.

In the description of the embodiment shown in the accompanying drawings, a petal type print wheel has been used as a print element in which the present invention is incorporated. However, it is to be understood that the invention is not limited to the specific form of the print wheel, and that the present invention can have application in a cylinder type print head 29 shown in FIG. 23 in which type members 27 and 28 are arranged in two layers or upper and lower layers and a glass-type print head 32 shown in FIG. 24 in which print members 30 and 31 are arranged in two layers or upper and lower layers, depending on the positions and sizes of the type members 27 and 28 and 30 and 31.

What is claimed is:

1. A print element for use in a printer which prints on paper and has a hammer member and means to move the print element to a predetermined printing position; the print element having a multiplicity of type members arranged in a plurality of layers with each type member carrying a type character on its front face, wherein the print element is moved to a predetermined printing position at which the back face of one type member is struck by the hammer member to print the character carried on its front face; the improvement in the print element being that the thicknesses of the type members are varied from one another, the thicknesses being taken in relationship to an imaginary common base plane perpendicular to the direction of motion of the hammer, such variance in thickness depending upon the layer in which each type member is arranged, the deviation of the center of each type member from the point at which the type member is struck by the hammer, and the vertical dimension of the character carried by the type member; such variance in thicknesses eliminating ghost printing caused by the undesired touching of the paper by the type member adjacent in layer to the type member struck by the member.

2. A print element as claimed in claim 1, wherein the print element is formed in a form of a disc type print wheel including a plurality of spokes and a center hub with the spokes extending radially from said hub and the spokes supporting at their outer end portions said type members.

3. A print element as claimed in claim 1, wherein the print element is formed in a form of a bowl type print wheel including a plurality of spokes arranged around a cylindrical surface and supporting at their outer end portion said type members.

* * * * *